US008890760B2

(12) United States Patent
Chen et al.

(10) Patent No.: US 8,890,760 B2
(45) Date of Patent: Nov. 18, 2014

(54) DUAL WIDEBAND DIPOLE ANTENNA

(71) Applicant: Southern Taiwan University of Technology, Tainan (TW)

(72) Inventors: Wen-Shan Chen, Tainan (TW); Hung-Ying Lin, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 175 days.

(21) Appl. No.: 13/685,970

(22) Filed: Nov. 27, 2012

(65) Prior Publication Data

US 2014/0145895 A1 May 29, 2014

(51) Int. Cl.
*H01Q 9/28* (2006.01)
*H01Q 9/16* (2006.01)

(52) U.S. Cl.
CPC ..... *H01Q 9/16* (2013.01)
USPC ..... 343/795; 343/803

(58) Field of Classification Search
CPC ..... H01Q 9/16
USPC ..... 343/793, 795, 803
See application file for complete search history.

(56) References Cited

U.S. PATENT DOCUMENTS

| | | | | |
|---|---|---|---|---|
| 7,501,991 | B2 * | 3/2009 | Yeap | 343/795 |
| 7,768,471 | B2 * | 8/2010 | Su et al. | 343/795 |
| 2004/0140941 | A1 * | 7/2004 | Joy et al. | 343/795 |
| 2009/0278758 | A1 * | 11/2009 | Zhao et al. | 343/803 |

* cited by examiner

*Primary Examiner* — Dieu H Duong
(74) *Attorney, Agent, or Firm* — Rosenberg, Klein & Lee

(57) ABSTRACT

A dual wideband dipole antenna used for wireless communication and receiving electromagnetic signals is revealed. The antenna mainly includes a dielectric substrate, two radiating metal portions and a feed line. Each radiating metal portion consists of a metal plate, an L-shaped metal piece and a rectangular metal sheet. An initial end of the metal plate has a feeding point. The metal plate has a regulatory segment and a projecting segment. The L-shaped metal piece is between a terminal end of the metal plate and the regulatory segment. The L-shaped metal piece has a turning portion. The rectangular metal sheet is between the terminal end of the metal plate and a rear end of the regulatory segment of the other metal plate. The feed line connects the feeding points. Thus the antenna is excited to produce resonance frequencies at 0.85, 1.13, 1.68, 1.93 and 2.29 GHz and cover GSM850/900/1800/1900 bands.

12 Claims, 25 Drawing Sheets

DUAL WIDEBAND DIPOLE ANTENNA

BACKGROUND OF THE INVENTION

1. Fields of the Invention

The present invention relates to a dual wideband dipole antenna, especially to a dual wideband dipole antenna used for wireless communication and receiving electromagnetic signals.

2. Descriptions of Related Art

Along with fast development of the wireless communication industry, the wireless communication technology has a huge impact on our lives today. It not only brings great convenience to people's life, but also shortens the distance between people. Thus almost everyone has got at least one mobile phone. The design of the mobile phone focuses on light weight and compact size. Moreover, multiple-bandwidth configuration has replaced a single bandwidth.

Furthermore, there is a trend to develop and research green (renewable) energy technology owing to the rising awareness of environment protection. Solar and wind power are two of the very best natural resources of energy, but both of them have their own disadvantages. For example, there is no power generated if there is a cloudy day or no wind. One of the main disadvantages is that large numbers of solar panels and wind generators are required to produce useful amounts of heat or electricity.

If the electromagnetic energy generated by wireless communication equipment can be collected and converted to electrical energy required, this is beneficial to the development of the green energy. The enormously expensive equipment in solar panels and wind generators can also be saved.

Thus there is a need to provide a novel communication antenna covering the operating bands of GSM850/900/1800/1900 and being able to be fed with electromagnetic energy at the operating bands of GSM850/900/1800/1900 for collecting and converting the electromagnetic energy into electric energy required.

SUMMARY OF THE INVENTION

Therefore it is a primary object of the present invention to provide a dual wideband dipole antenna with a resonant frequency of 0.85 GHz, 1.13 GHz, 1.68 GHz, 1.93 GHz and 2.29 GHz and covering GSM frequency bands 850/900/1800/1900, used in wireless communication and for receiving electromagnetic signals.

In order to achieve the above object, a dual wideband dipole antenna of the present invention includes a dielectric substrate, two radiating metal portions and a feed line.

The two radiating metal portions are arranged at the dielectric substrate and are corresponding to each other. Each radiating metal portion is composed of a metal plate, an L-shaped metal piece and a rectangular metal sheet. A feeding point is disposed on an initial end of the metal plate while a regulatory segment is extended and bent from a middle part of the metal plate toward the initial end and a terminal end of the metal plate is bent and turned toward a first direction to form a projecting segment. The L-shaped metal piece is set between the terminal end of the metal plate and the regulatory segment. The L-shaped metal piece further includes a turning portion turning from the terminal end toward a second direction. The rectangular metal sheet is located between the terminal end of the metal plate and a rear end of the regulatory segment of the other metal plate.

The feed line connects the two feeding points respectively on the metal plate of each radiating metal portion.

Thereby the antenna is excited by the rectangular metal sheet to produce resonant frequency at 0.85 GHz. The resonant frequencies at 1.13 GHz and 2.29 GHz of the antenna are excited by the metal plate while the resonant frequency at 1.68 GHz of the antenna is excited by the L-shaped metal piece, the turning portion and the projecting segment. The regulatory segment is used to excite the resonant frequency at 1.93 GHz. Thus the antenna covers operating bands of GSM850/900/1800/1900, etc, able to be used for wireless communication (covering GSM850/900/1800/1900 bands) and receiving electromagnetic signals In the dual wideband dipole antenna, a slit is formed on one side of the feeding point of the metal plate and is used for IF (intermediate frequency) matching.

In the dual wideband dipole antenna, a slot is mounted on the other side of the feeding point of the metal plate is used for IF (intermediate frequency) matching.

In the dual wideband dipole antenna, the dielectric substrate is a FR4 substrate with a relative permittivity (relative dielectric constant) of 4.4 ($\in r=4.4$), a loss tangent of 0.0245, a thickness of 0.8 mm and an area of $20\times200$ mm$^2$.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
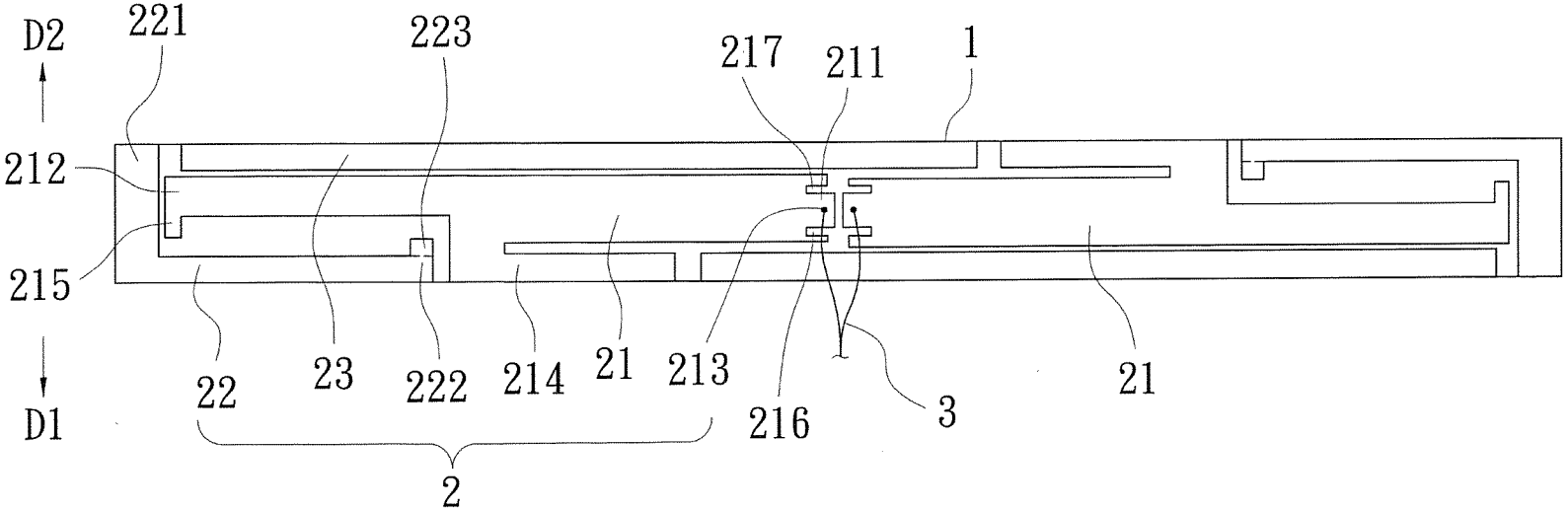
FIG. 1 is a schematic drawing showing structure of an antenna according to the present invention.

Refer to FIG. 1, a dual wideband dipole antenna of the present invention mainly includes a dielectric substrate 1, two radiating metal portions 2 and a feed line 3.

The dielectric substrate 1 is a FR4 substrate with a relative permittivity (relative dielectric constant) of 4.4 ($\in r=4.4$), a loss tangent of 0.0245, a thickness of 0.8 mm and an area of $20\times200$ mm$^2$.

The two radiating metal portions 2 are disposed on the dielectric substrate 1 and are corresponding to each other. The radiating metal portion 2 consists of a metal plate 21, an L-shaped metal piece 22 and a rectangular metal sheet 23. The metal plate 21 has an initial end 211 and a terminal end 212 opposite to the initial end 211. The initial end 211 is disposed with a feeding point 213. A middle part of the metal plate 21 is bent 180 degrees and extended toward the initial end 211 to form a regulatory segment 214 while the terminal end 212 of the metal plate 21 is bent and turned toward a first direction D1 of the dielectric substrate 1 to form a projecting segment 215. In order to increase the IF (intermediate frequency) bandwidth, the L-shaped metal piece 22 is arranged between the terminal end 212 of the metal plate 21 and the regulatory segment 214. The L-shaped metal piece 22 also includes an initial end 221 and a terminal end 222. The initial end 221 is toward a second direction D2 of the dielectric substrate 1 while the terminal end 222 is located at the first direction D1 of the dielectric substrate 1. The second direction D2 and the first direction D1 are opposite to each other. The terminal end 222 of the L-shaped metal piece 22 further is bent and turned toward the second direction D2 to form a turning portion 223. As to the rectangular metal sheet 23, it is arranged at the second direction D2 and located between the terminal end 212 of the metal plate 21 and a rear end of the regulatory segment 214 of the other metal plate 21.

The feed line 3 connects the feeding points 213 respectively on each metal plate 21 of the radiating metal portion 2.

A slit 216 is formed on one side of the feeding point 213 of the metal plate 21 while a slot 217 is mounted on the other side of the feeding point 213. Both the slit 216 and the slot 217 are designed for IF (intermediate frequency) matching. The slit 216 and the slot 217 can be respectively disposed on each of two sides of the feeding point 213 of the metal plate 21 or alternatively on one side of the feeding point 213.

According to the above structure, the antenna is excited by the rectangular metal sheet 23 to produce resonant frequency at 0.85 GHz. The resonant frequencies at 1.13 GHz and 2.29 GHz of the antenna are excited by the metal plate 21 while the resonant frequency at 1.68 GHz of the antenna is excited by the L-shaped metal piece 22, the turning portion 223 and the projecting segment 215. The regulatory segment 214 is used to excite the resonant frequency at 1.93 GHz. Thus the antenna cover operating bands of GSM850(824-894 GHz)/900(890-960 GHz)/1800(1710-1880 GHz)/1900(1850-1990 GHz), etc, able to be used as antenna for wireless communication (covering GSM850/900/1800/1900 bands) and receiving electromagnetic signals.

Figure 2A:
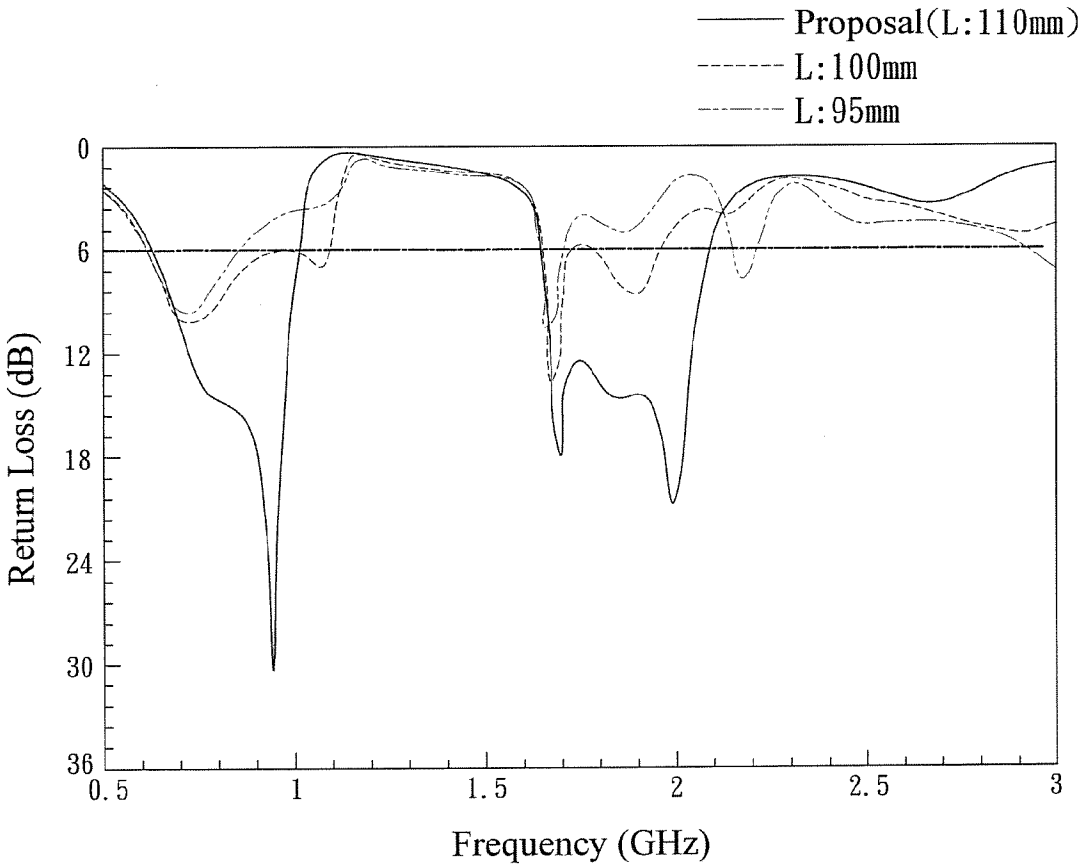
FIG. 2*a* is a schematic drawing showing effect of a rectangular metal sheet on return loss of an antenna according to the present invention.
Figure 2B:
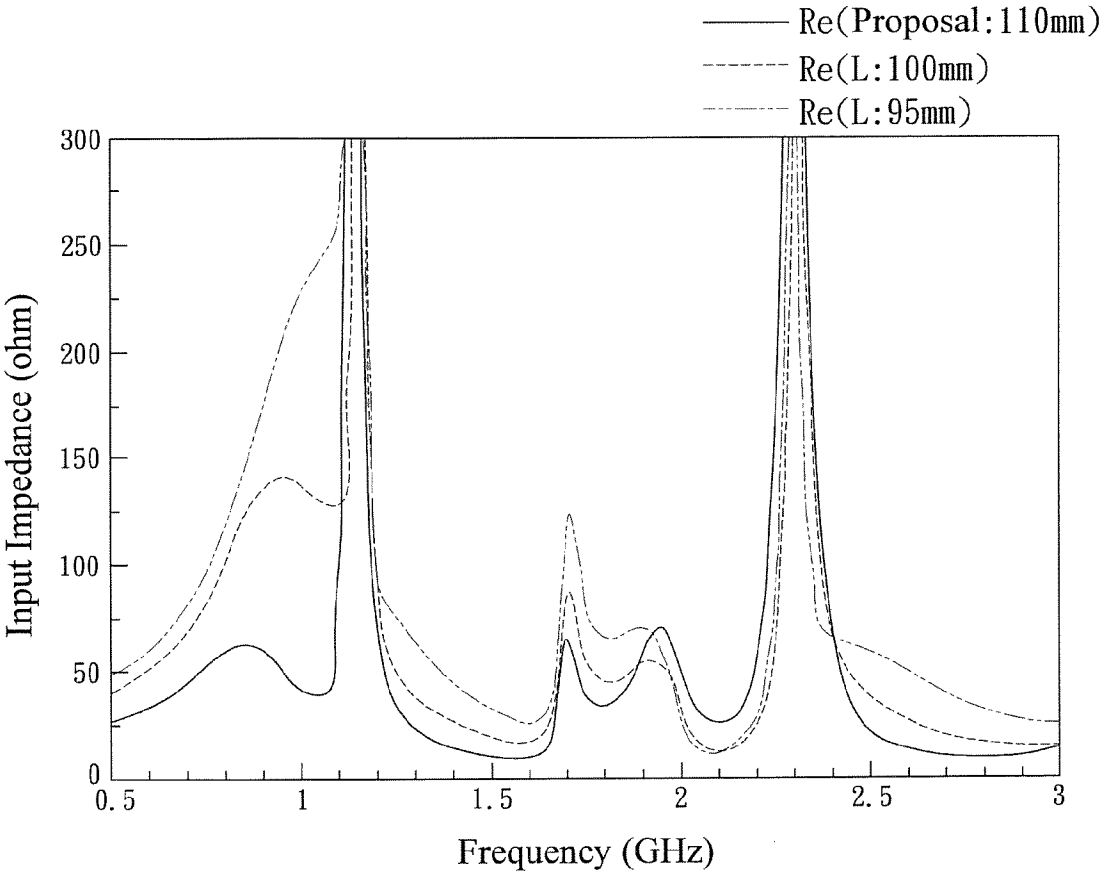
FIG. 2*b* is a schematic drawing showing effect of a rectangular metal sheet on input impedance of an antenna according to the present invention.
Figure 2C:
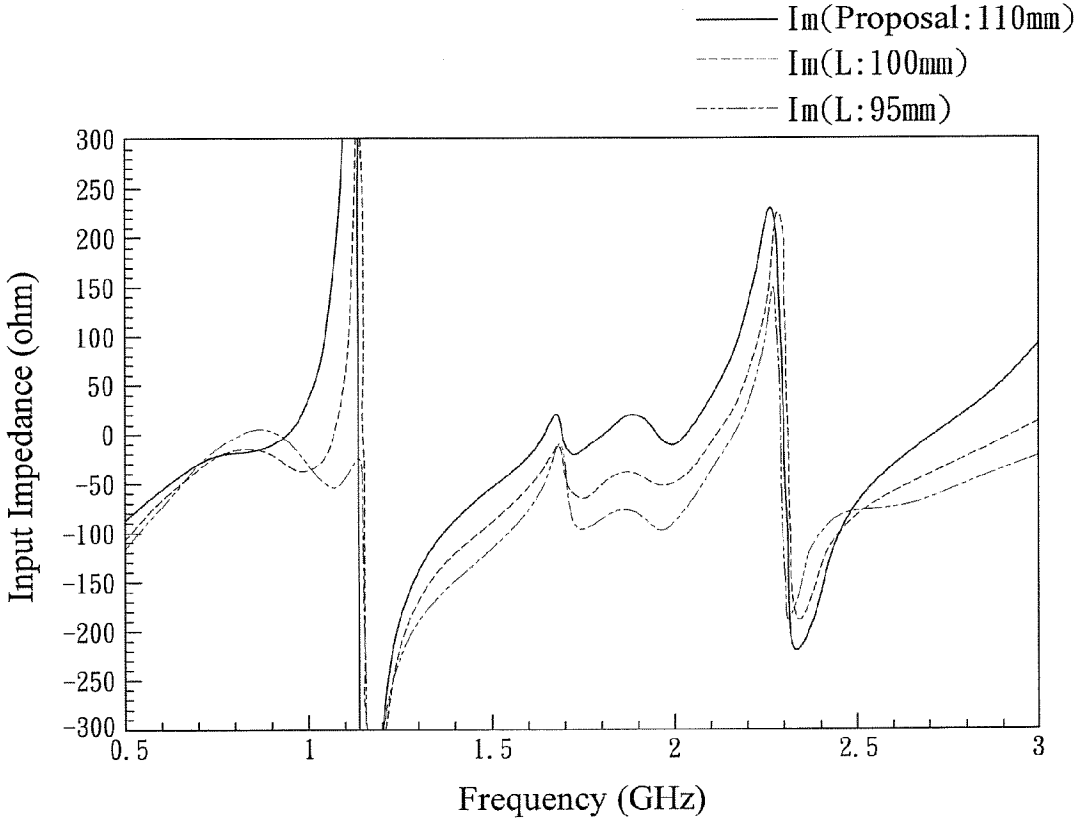
FIG. 2*c* is another schematic drawing showing effect of a rectangular metal sheet on input impedance of an antenna according to the present invention.

Refer to FIG. 2*a*, FIG. 2*b*, and FIG. 2*c*, schematic drawings showing return loss vs frequency and input impedance vs frequency of an embodiment with different lengths of the rectangular metal sheet 23 are disclosed. Viewing the impedance, the low frequency mode at 0.85 GHz gradually moves toward high frequency end along with shortening of the length (path). At the low frequency part, the length of each of the symmetric coupled upper and lower metal sheets 21 are about a quarter wavelength. The total length is a half wavelength.

Figure 3A:
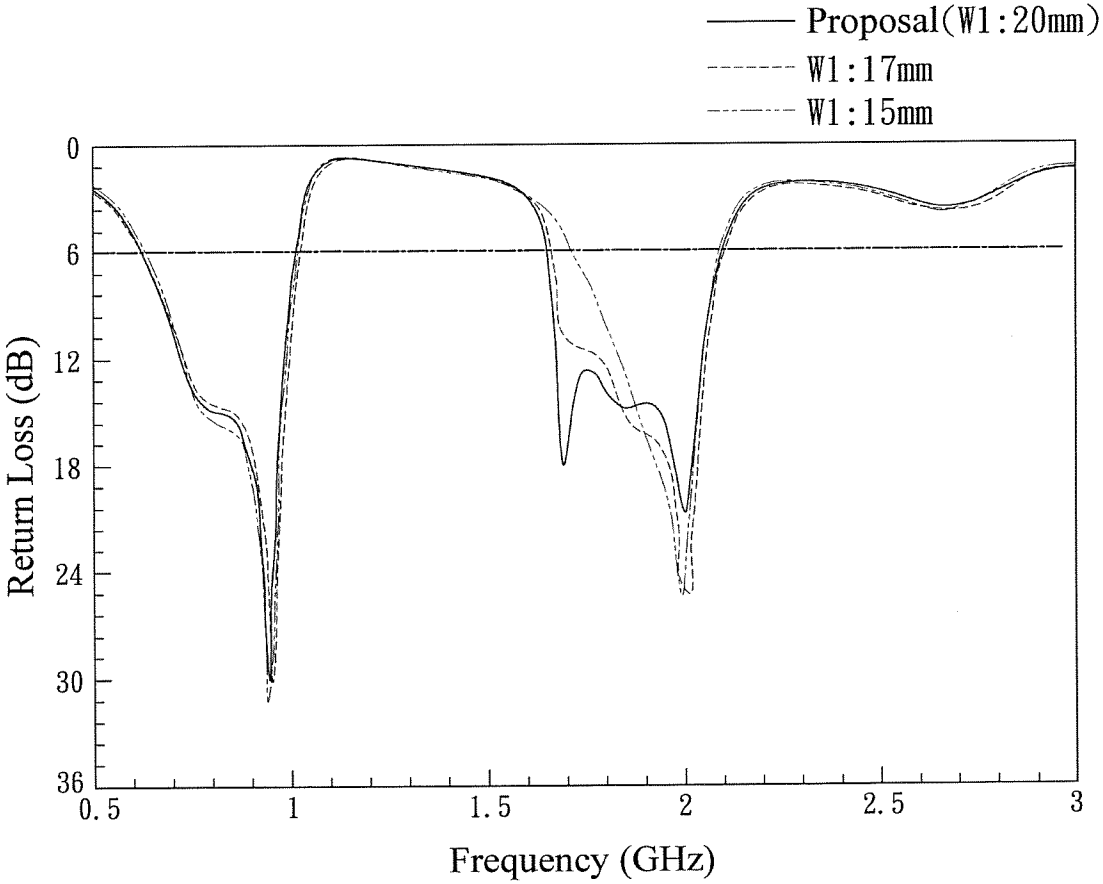
FIG. 3*a* is a schematic drawing showing effect of an L-shaped metal piece on return loss of an antenna according to the present invention.
Figure 3B:
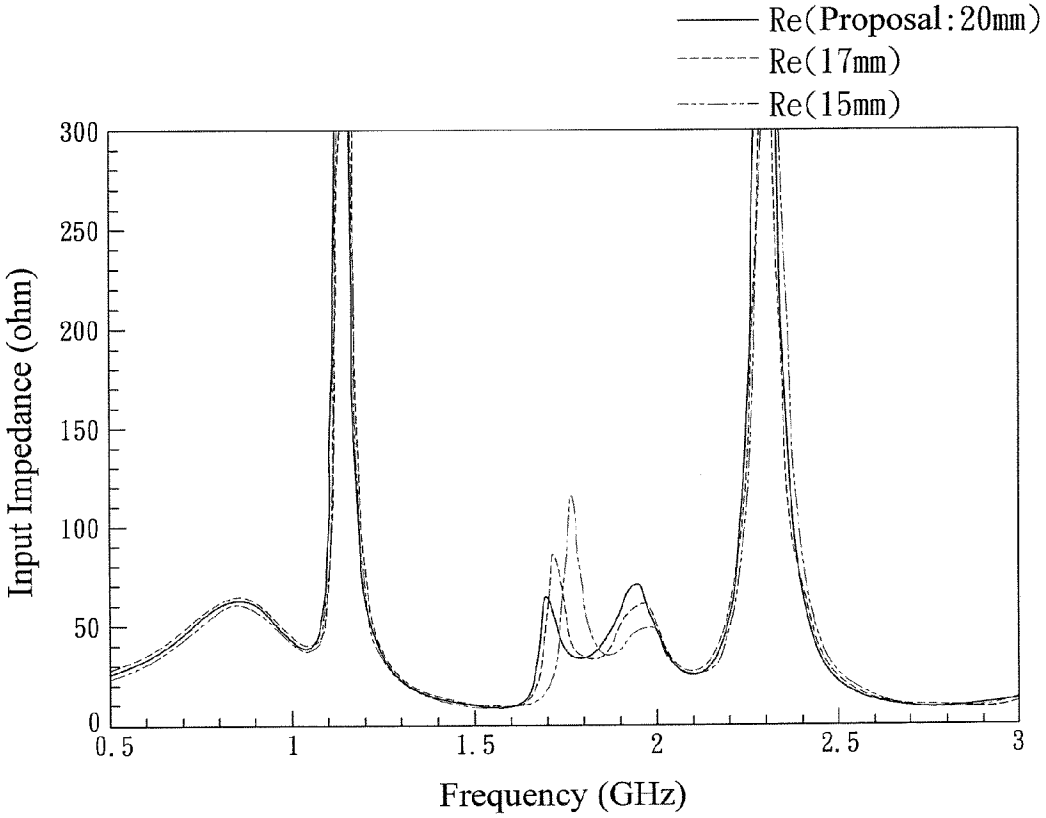
FIG. 3*b* is a schematic drawing showing effect of an L-shaped metal piece on input impedance of an antenna according to the present invention.
Figure 3C:
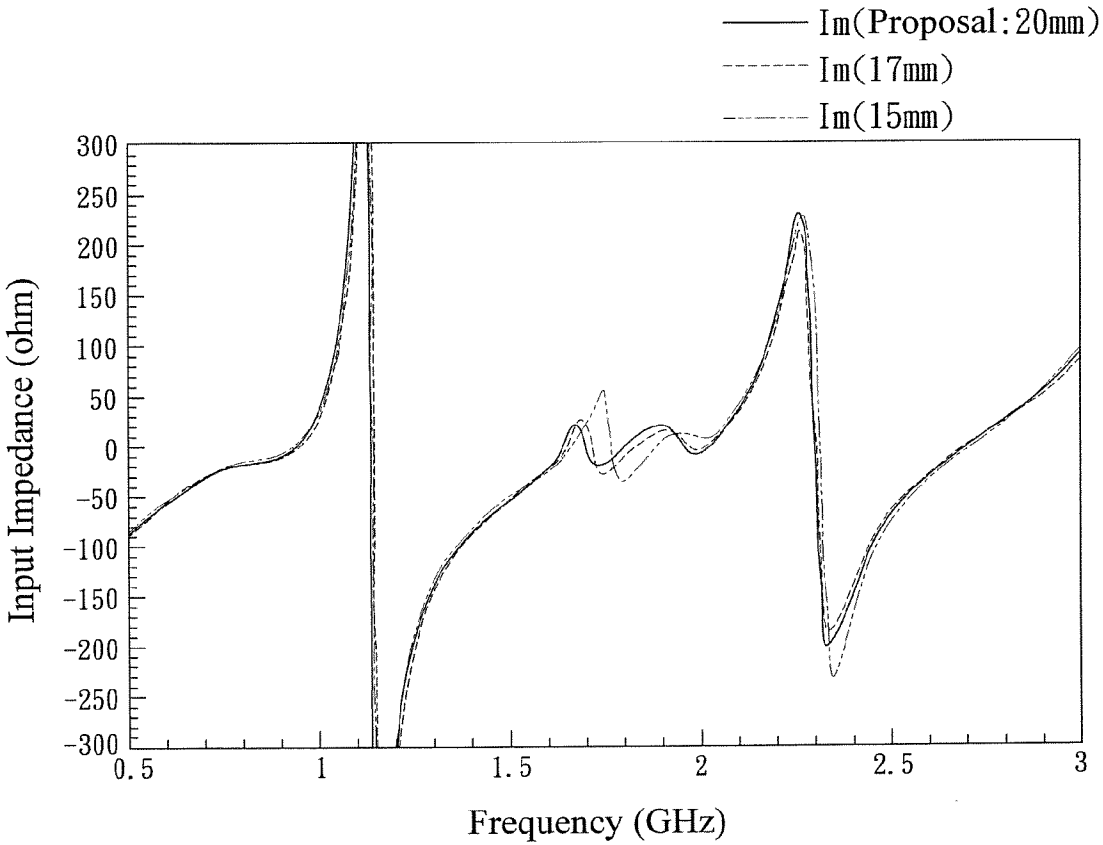
FIG. 3*c* is another schematic drawing showing effect of an L-shaped metal piece on input impedance of an antenna according to the present invention.

Refer to FIG. 3*a*, FIG. 3*b*, and FIG. 3*c*, a return loss vs frequency graph and input impedance vs frequency graphs of an embodiment with different lengths of the two L-shaped metal pieces 22 are revealed. When the length of both the L-shaped metal pieces 22 is reduced, the mode at 1.68 GHz slightly shifts toward the high frequency end. In this mode, the path is respectively a quarter wavelength. Thus the total path is a half wavelength.

Figure 4A:
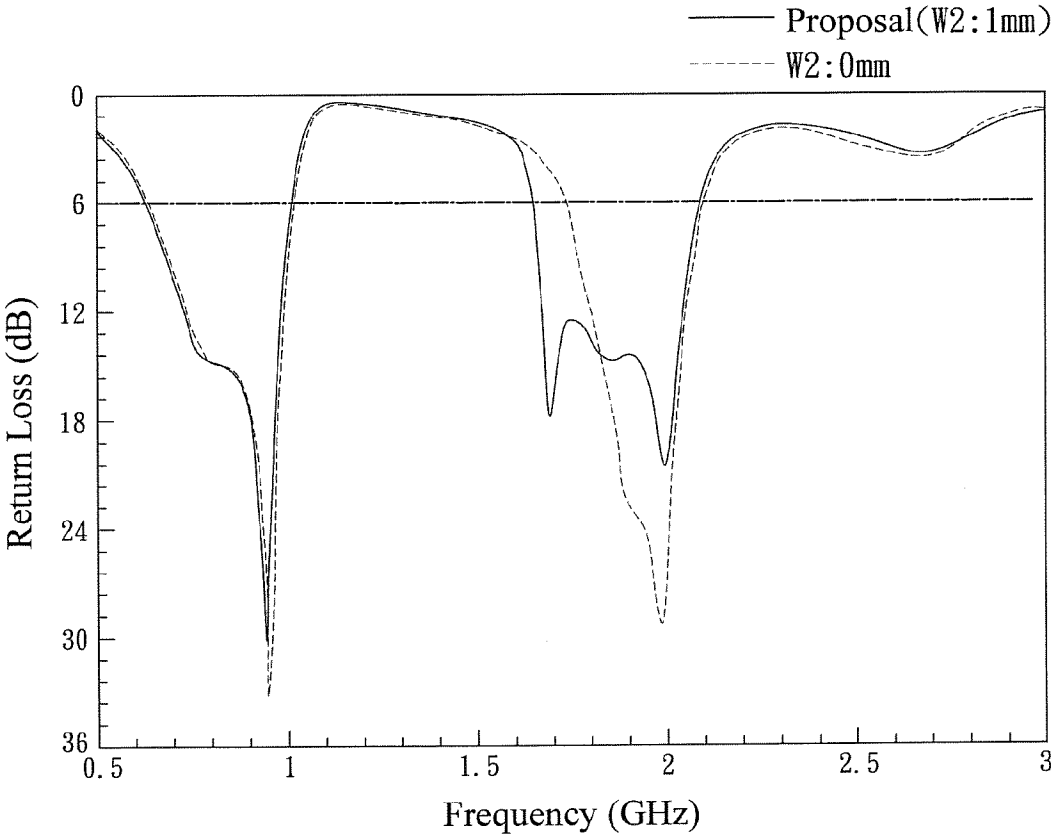
FIG. 4*a* is a schematic drawing showing effect of a turning portion on return loss of an antenna according to the present invention.
Figure 4B:
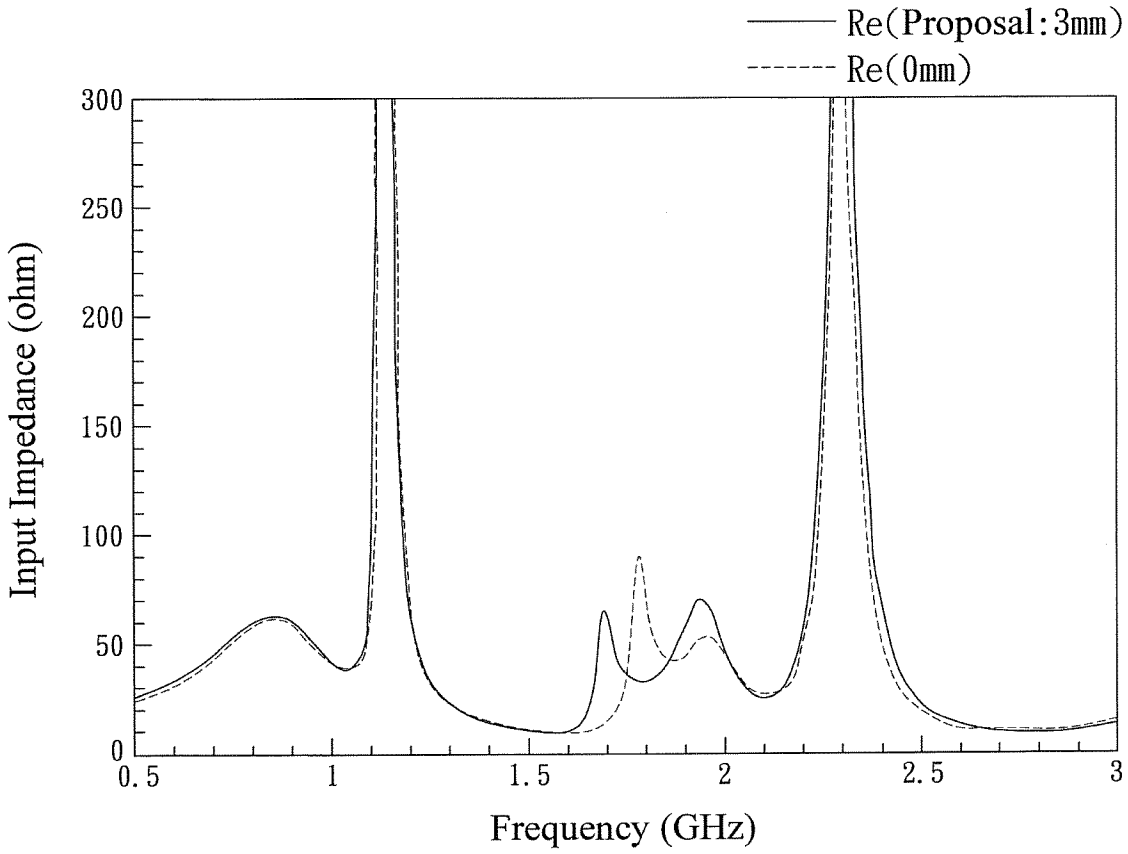
FIG. 4*b* is a schematic drawing showing effect of a turning portion on input impedance of an antenna according to the present invention.
Figure 4C:
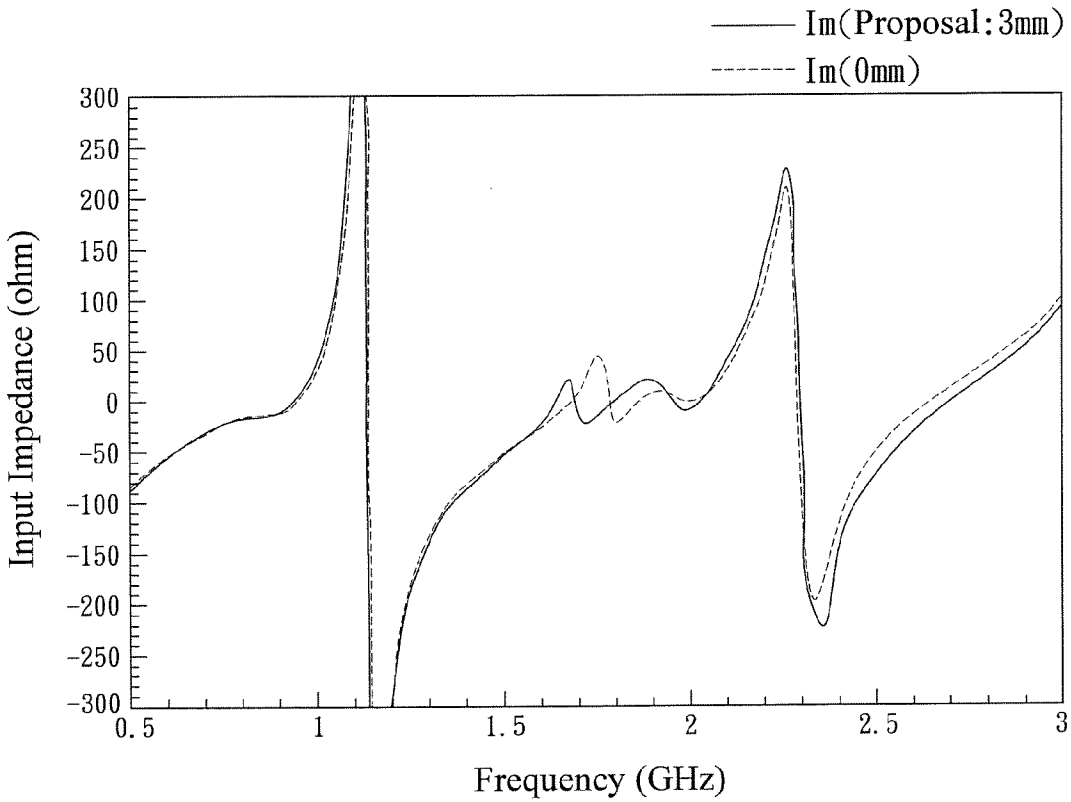
FIG. 4*c* is another schematic drawing showing effect of a turning portion on input impedance of an antenna according to the present invention.

Refer to FIG. 4*a*, FIG. 4*b*, and FIG. 4*c*, the impact of the existence of the turning portion 223 on the return loss and the input impedance is shown in this embodiment. When the two turning portions 223 are removed, it is shown that the turning portions 223 only have impact at the 1.68 GHz region according to these figures. This is due to that the turning portion 223 is one of the paths of the antenna at 1.68 GHz.

Figure 5A:
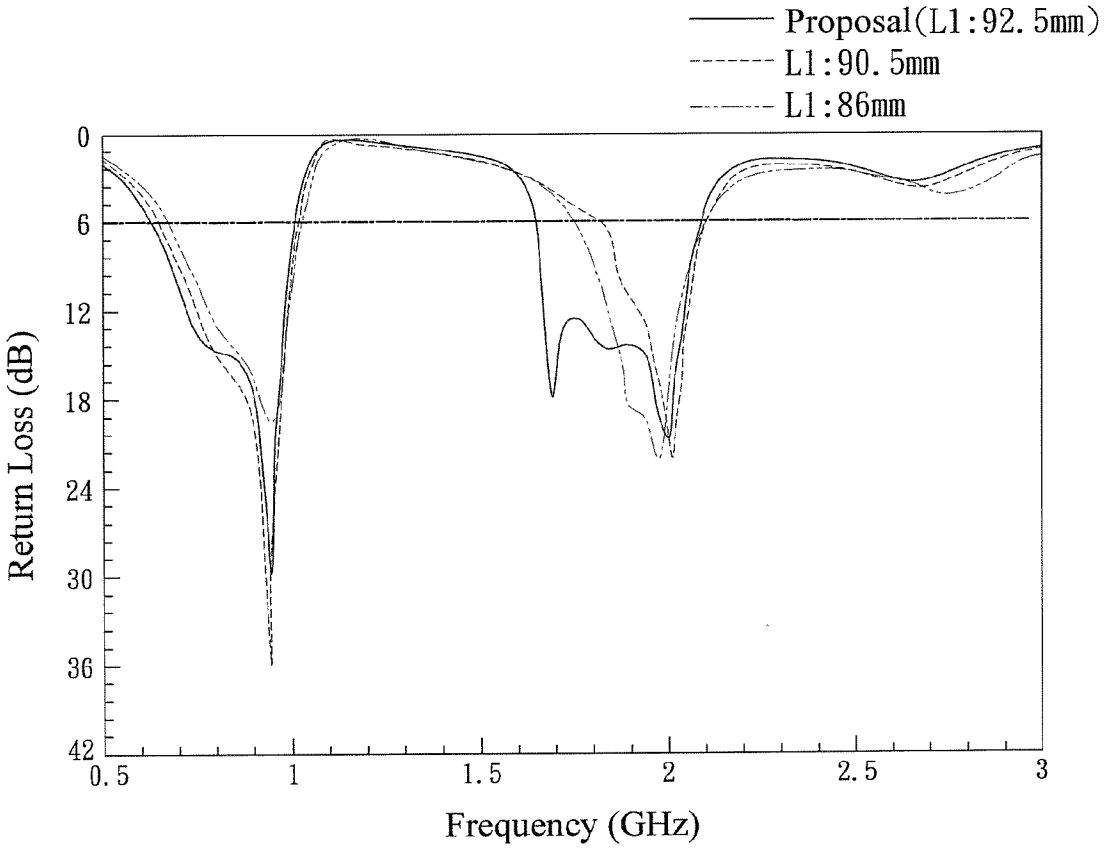
FIG. 5*a* is a schematic drawing showing effect of a metal plate on return loss of an antenna according to the present invention.
Figure 5B:
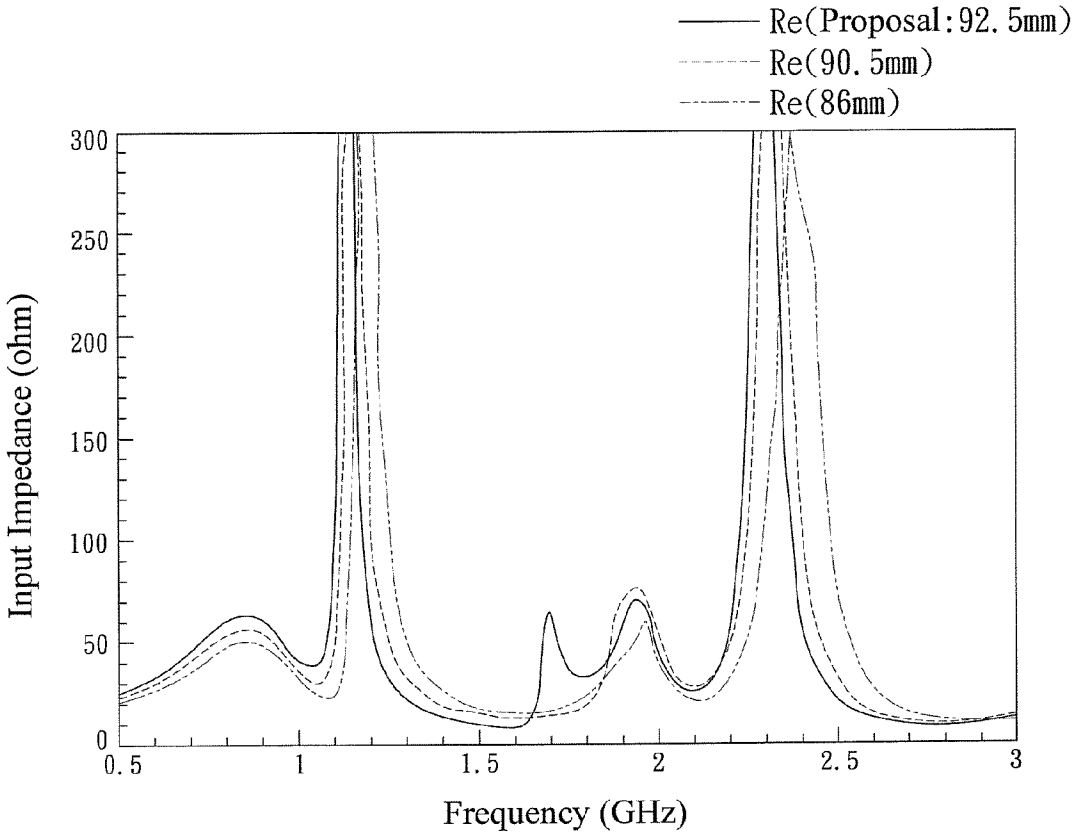
FIG. 5*b* is a schematic drawing showing effect of a metal plate on input impedance of an antenna according to the present invention.
Figure 5C:
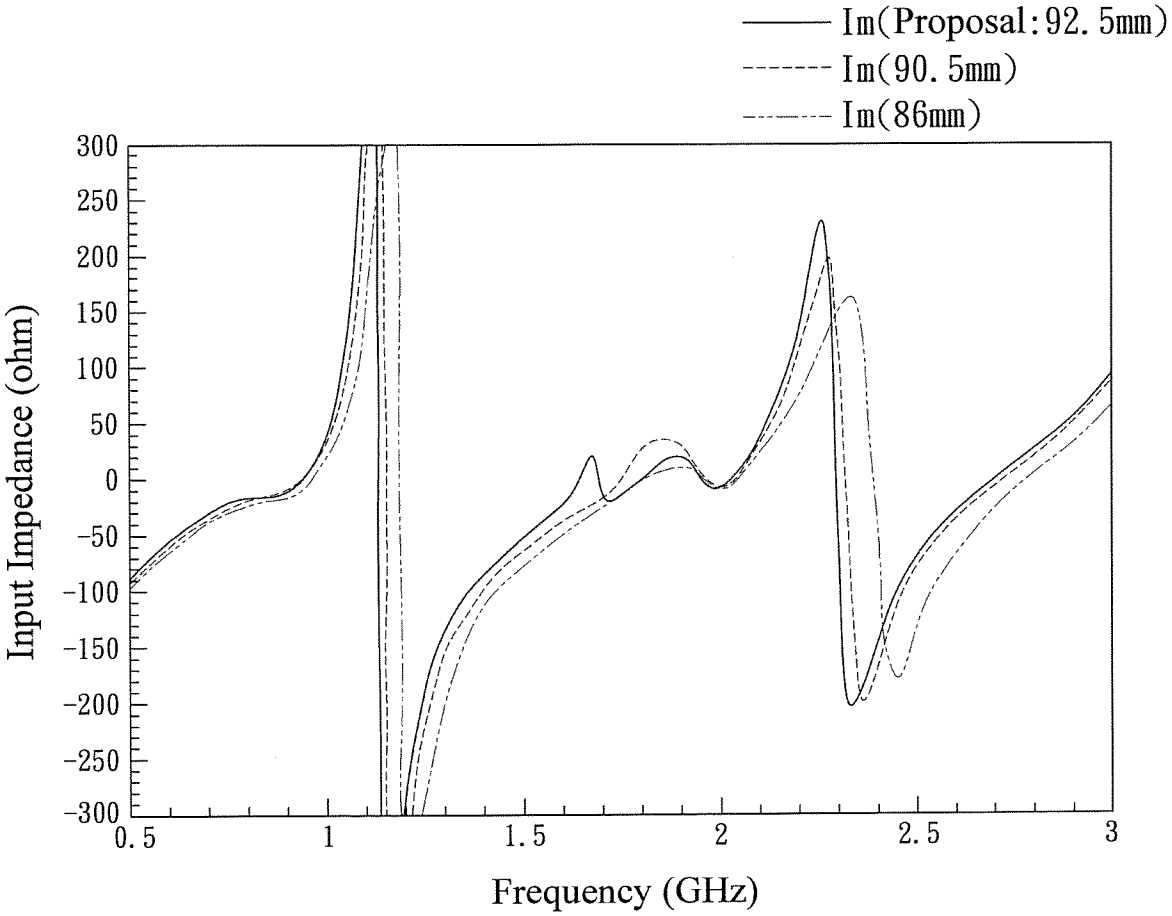
FIG. 5*c* is another schematic drawing showing effect of a metal plate on input impedance of an antenna according to the present invention.

Refer to FIG. 5*a*, FIG. 5*b*, and FIG. 5*c*, the effect of the modified resonant path of the metal plate 21 on the return loss and the input impedance is shown in this embodiment. The two resonant paths feeding from the left and right metal plates 21 are used for excitation of two modes at 1.13 GHz and 2.29 GHz respectively. The resonant path of one metal plate 21 is a quarter wavelength while the resonant path of the other metal plate 21 is also a quarter wavelength. Thus the total length is a half wavelength. In view of the FIG. 5*b*, and FIG. 5*c*, the modification of the path makes the original two modes at 1.13 GHz, 2.29 GHz move toward the high frequency end. The mode at 1.68 GHz also moves. This is due to that this mode uses the two metal plates 21 respectively coupled to each of the two L-shaped metal pieces 22. Thus once the length of the metal plate 21 is changed, the mode at 1.68 GHz is also affected.

Figure 6A:
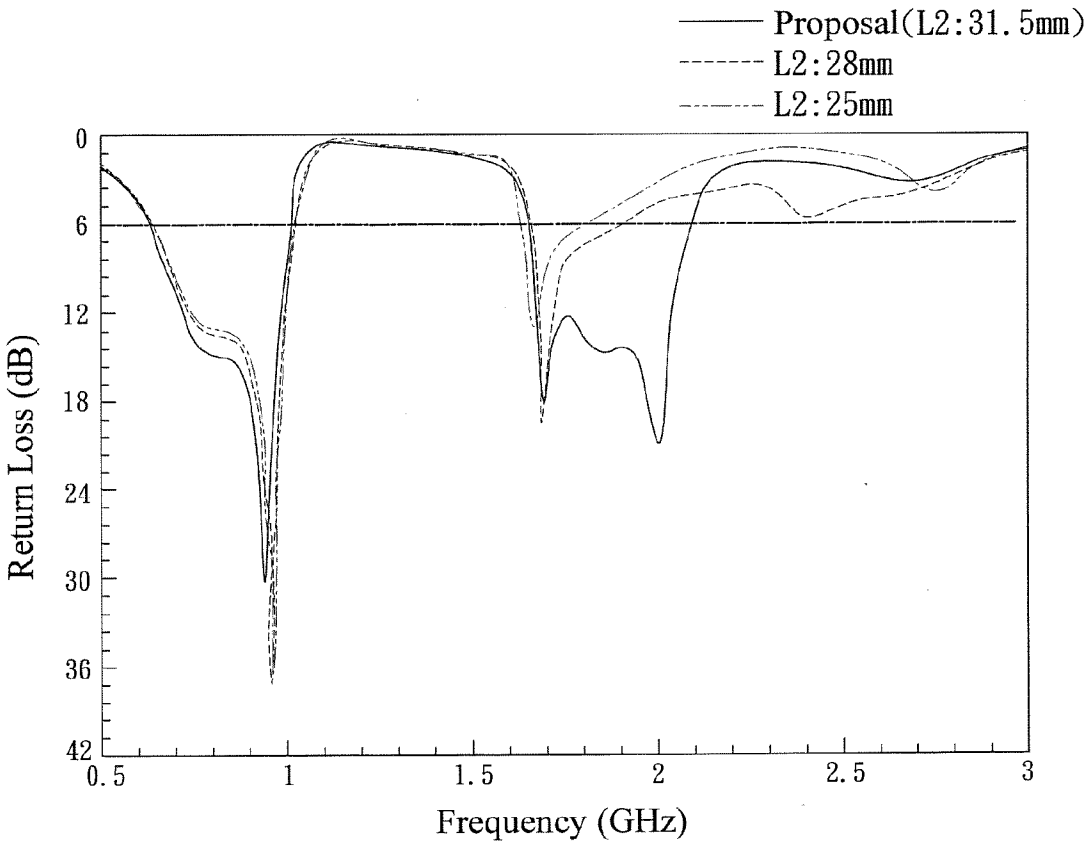
FIG. 6*a* is a schematic drawing showing effect of a regulatory segment on return loss of an antenna according to the present invention.
Figure 6B:
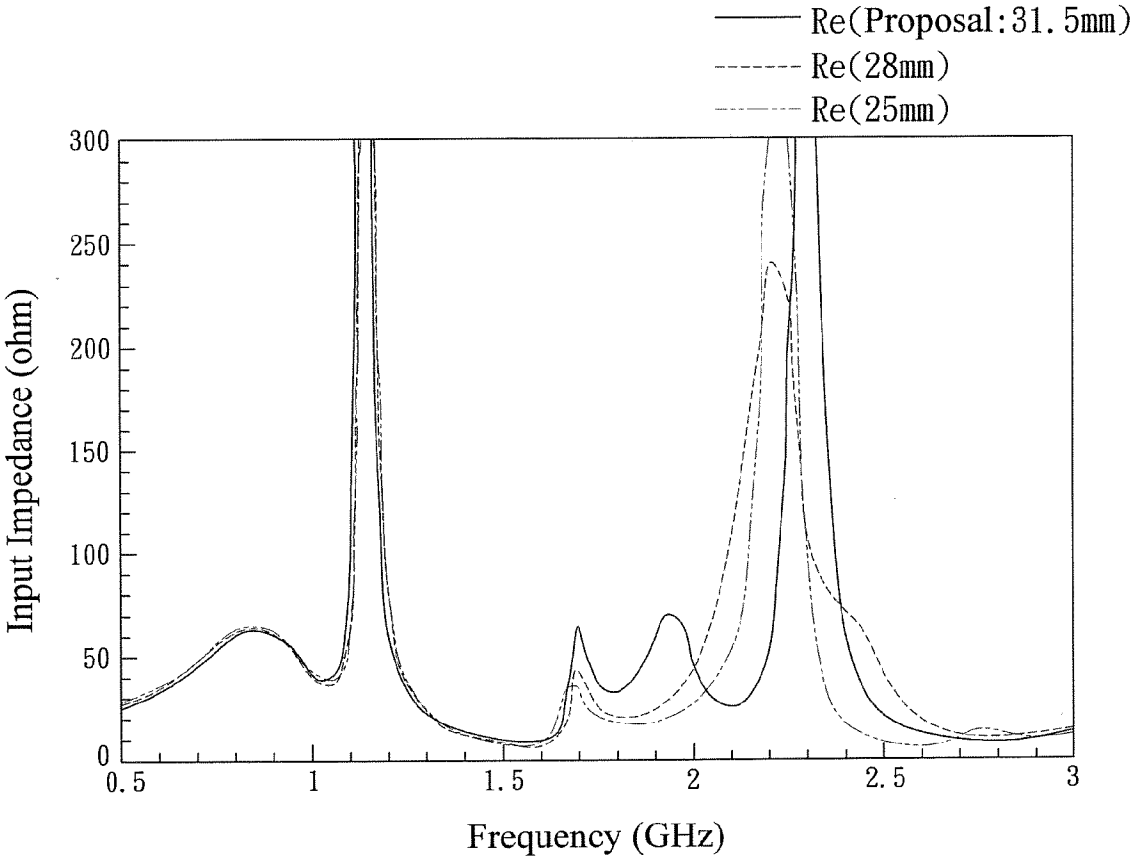
FIG. 6*b* is a schematic drawing showing effect of a regulatory segment on input impedance of an antenna according to the present invention.
Figure 6C:
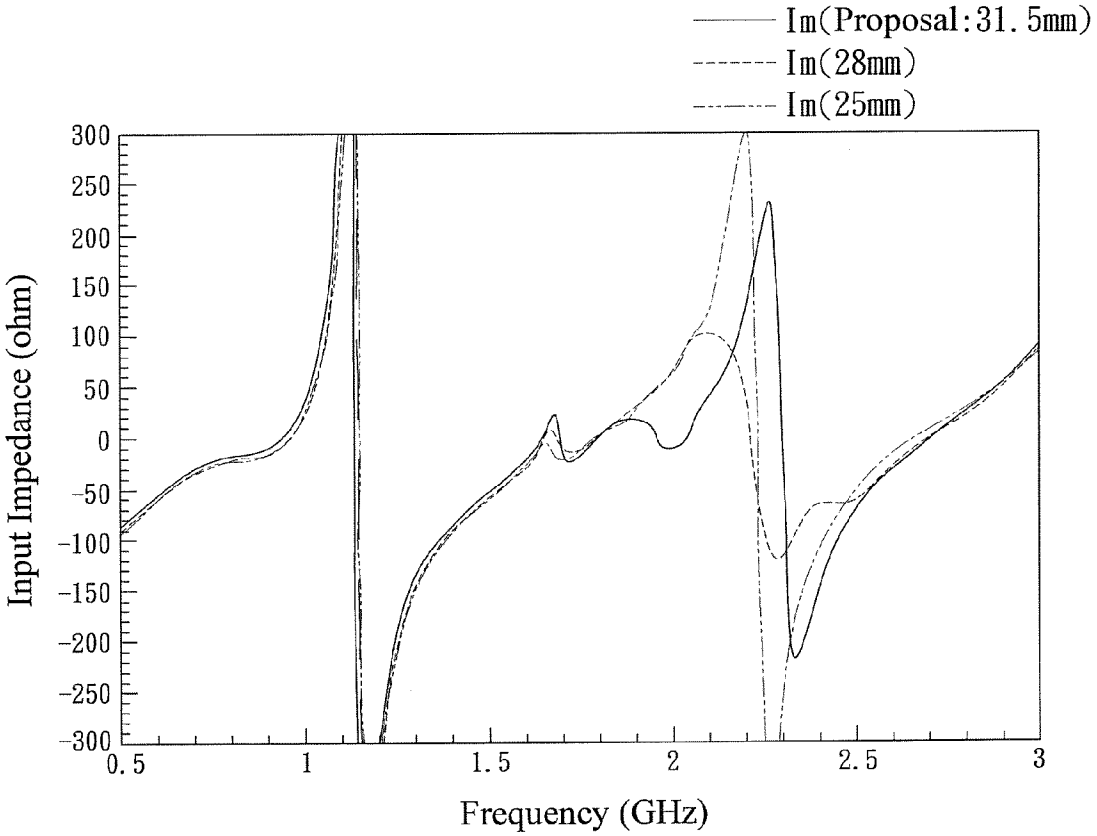
FIG. 6*c* is another schematic drawing showing effect of a regulatory segment on input impedance of an antenna according to the present invention.

Refer to FIG. 6*a*, FIG. 6*b*, and FIG. 6*c*, a return loss vs frequency graph and input impedance vs frequency graphs of an embodiment with different lengths of the regulatory segment 214 are revealed. The regulatory segment 214 is a new path generated in order to cover the operating bands. A mode of this path is mainly produced by one regulatory segment 214 that is a quarter wavelength and the other regulatory segment 214 that is a quarter wavelength. Thus the total path is a half wavelength.

Figure 7A:
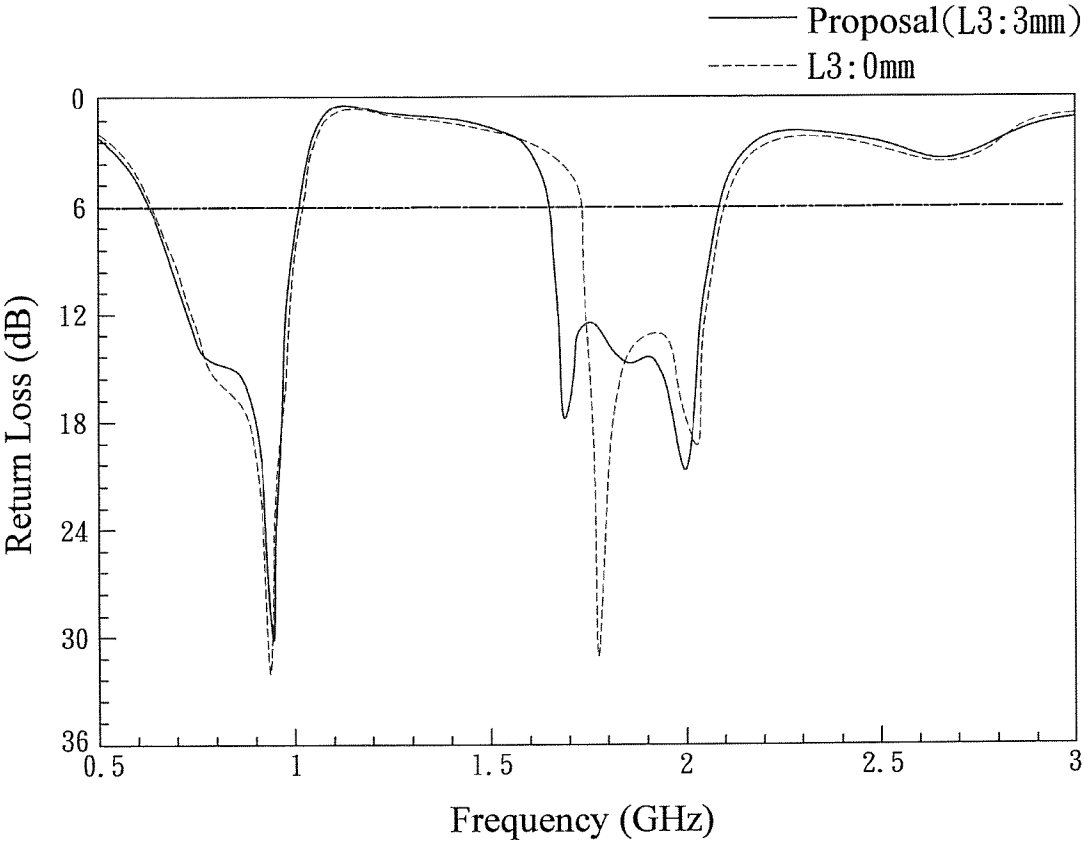
FIG. 7*a* is a schematic drawing showing effect of a projecting segment on return loss of an antenna according to the present invention.
Figure 7B:
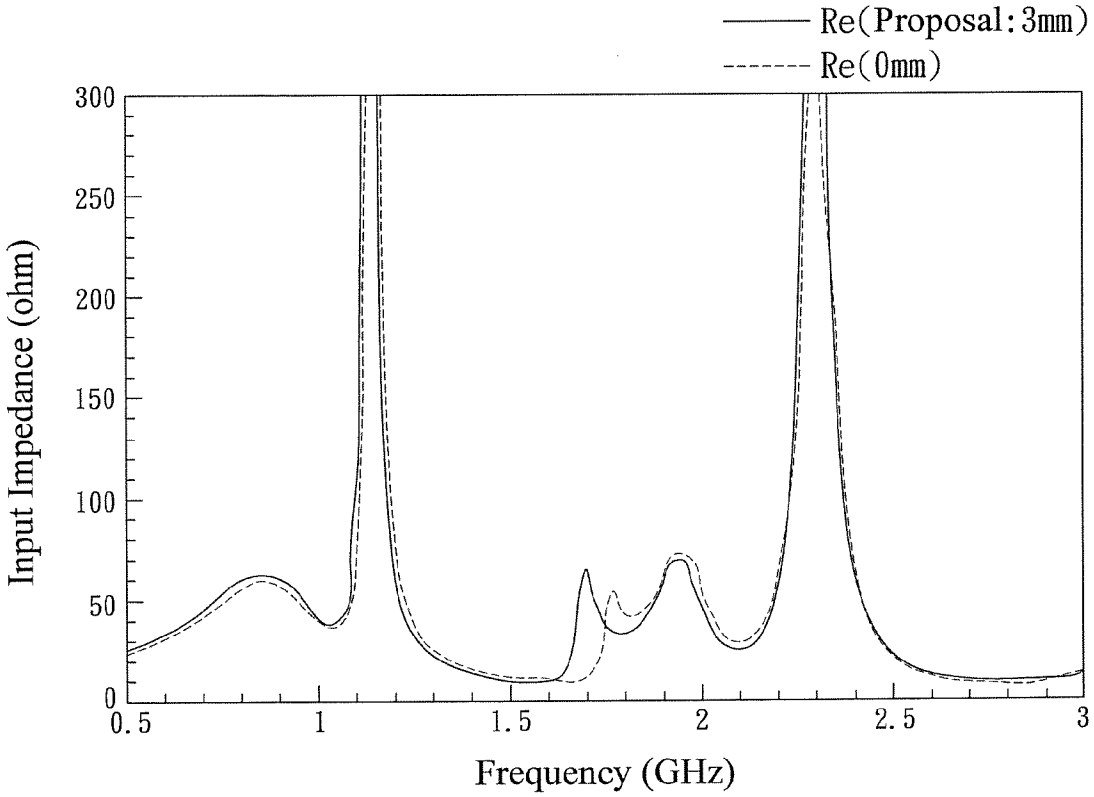
FIG. 7*b* is a schematic drawing showing effect of a projecting segment on input impedance of an antenna according to the present invention.
Figure 7C:
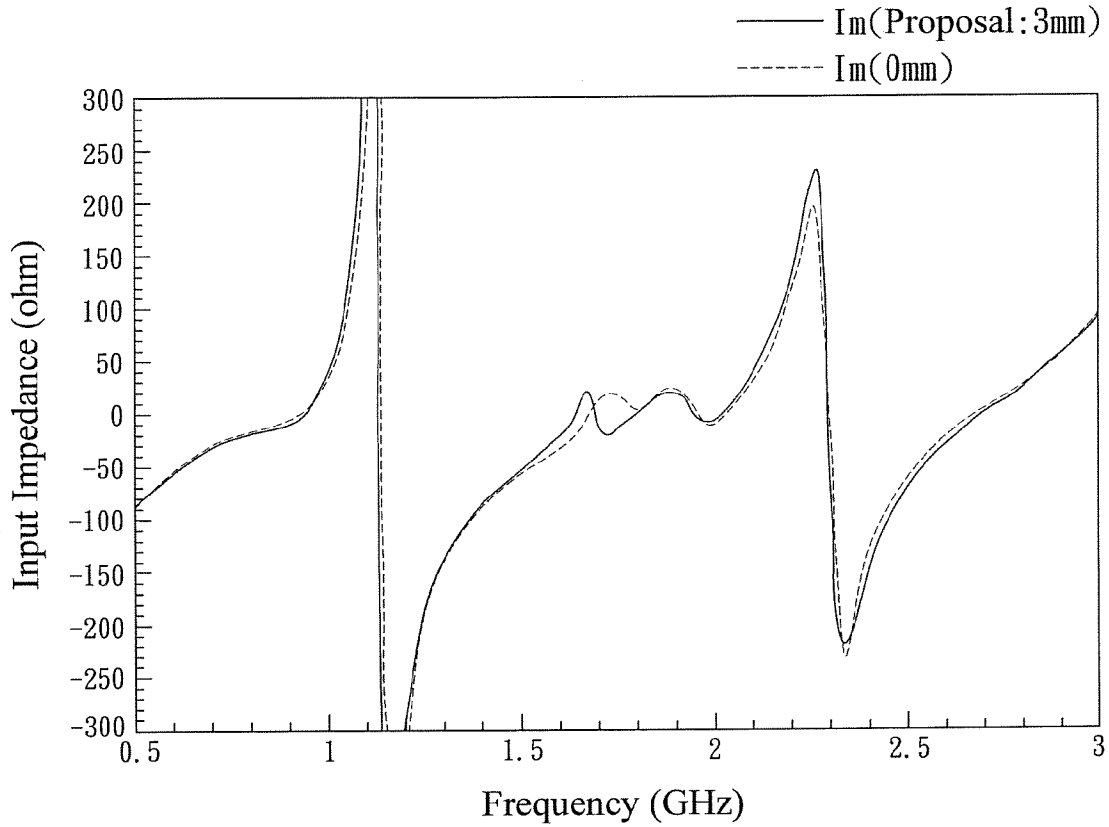
FIG. 7*c* is another schematic drawing showing effect of a projecting segment on input impedance of an antenna according to the present invention.

Refer to FIG. 7*a*, FIG. 7*b*, and FIG. 7*c*, the influence of the existence of the projecting segment 215 on the return loss and the input impedance is revealed. The projecting segment 215 mainly affects the L-shaped metal piece 22 coupled therewith. In view of the return loss shown in FIG. 7*a*, and the input impedance shown in FIG. 7*b* and FIG. 7*c*, when each projecting segment 215 has been removed, only the mode at 1.68 GHz is affected. The removal of the projecting segment 215 leads to change of the path and the resonant path is shortened. Thus the mode at 1.68 GHz shifts toward the high frequency end.

Figure 8A:
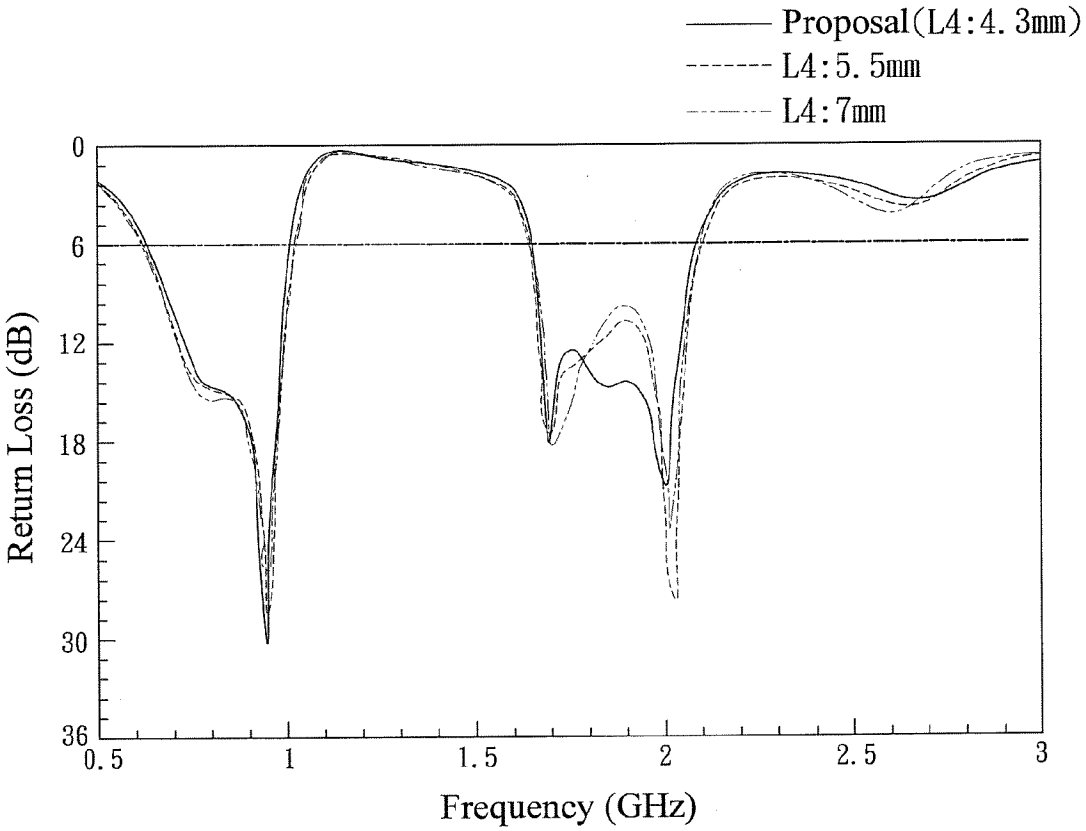
FIG. 8*a* is a schematic drawing showing effect of a slit on return loss of an antenna according to the present invention.
Figure 8B:
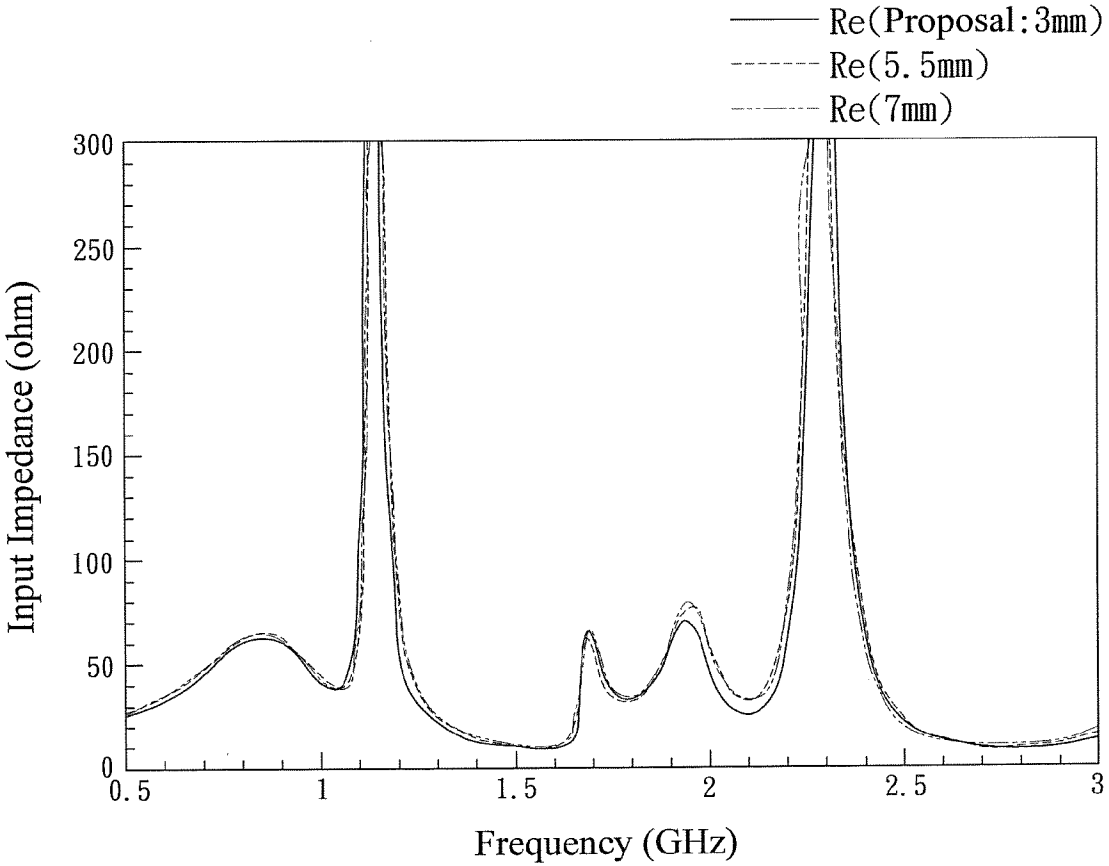
FIG. 8*b* is a schematic drawing showing effect of a slit on input impedance of an antenna according to the present invention.
Figure 8C:
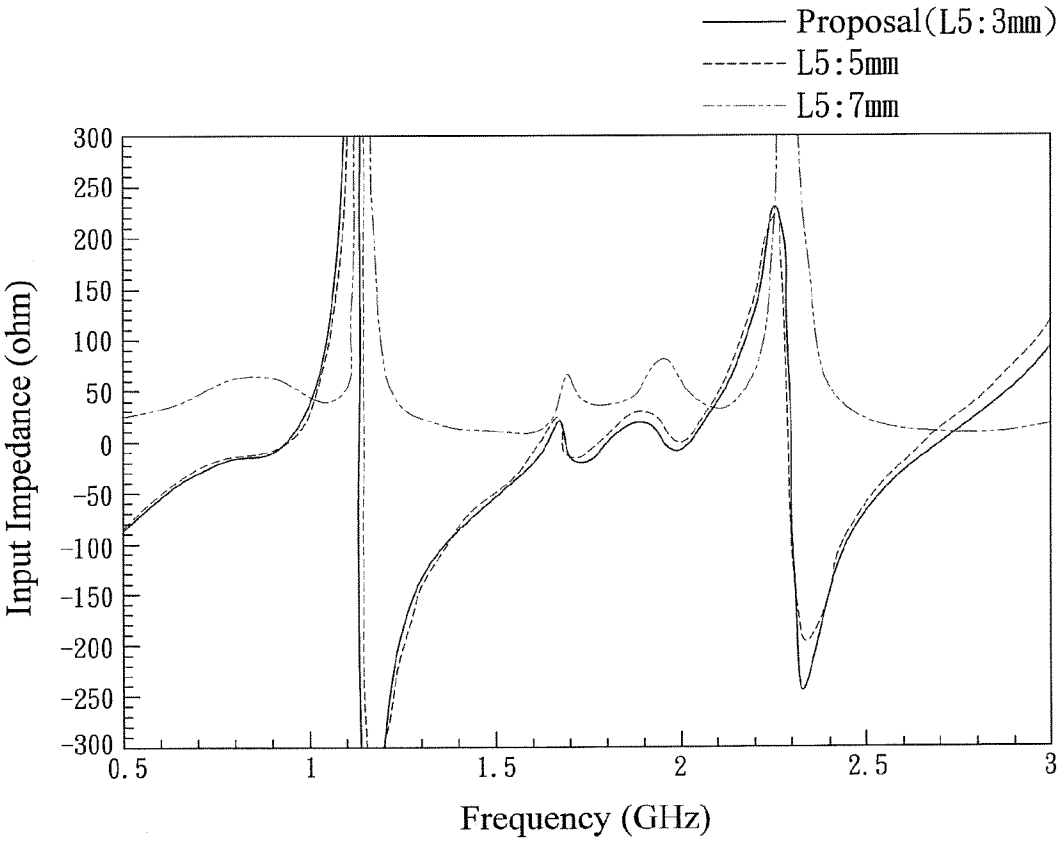
FIG. 8*c* is another schematic drawing showing effect of a slit on input impedance of an antenna according to the present invention.

Refer to FIG. 8*a*, FIG. 8*b*, and FIG. 8*c*, the effect of the slit 216 formed on one side of the feeding point 213 on the return loss and the input impedance is disclosed. Refer to the return loss shown in FIG. 8*a*, poor matching at the intermediate frequency is obviously observed when the position of the slit 216 is gradually shifted from the edge to the inside of the metal plate 21. In view of an imaginary part of the FIG. 8*b* and FIG. 8*c*, the imaginary part of the mode at 1.92 GHz is gradually moving toward the positive area. Thus the mode at 1.92 GHz is not matched. Therefore the slit 216 is mainly used to change the intermediate frequency matching.

Figure 9A:
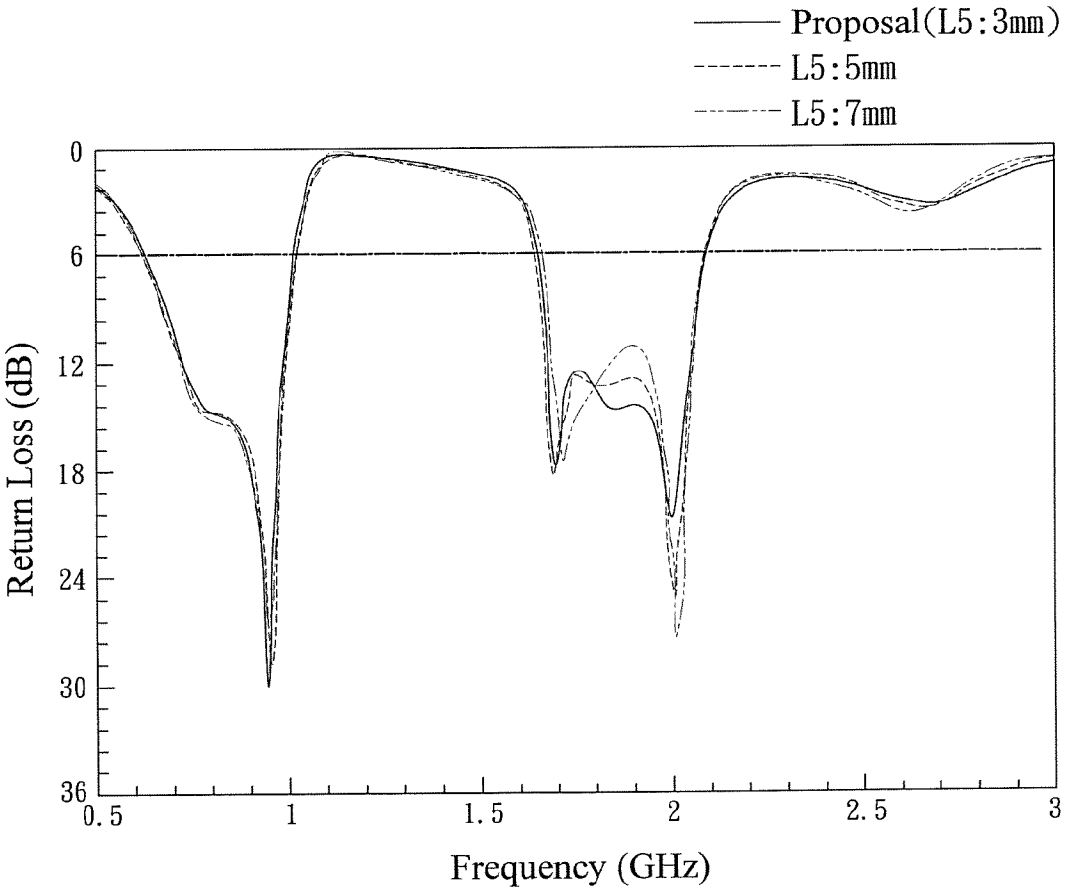
FIG. 9*a* is a schematic drawing showing effect of a slot on return loss of an antenna according to the present invention.
Figure 9B:
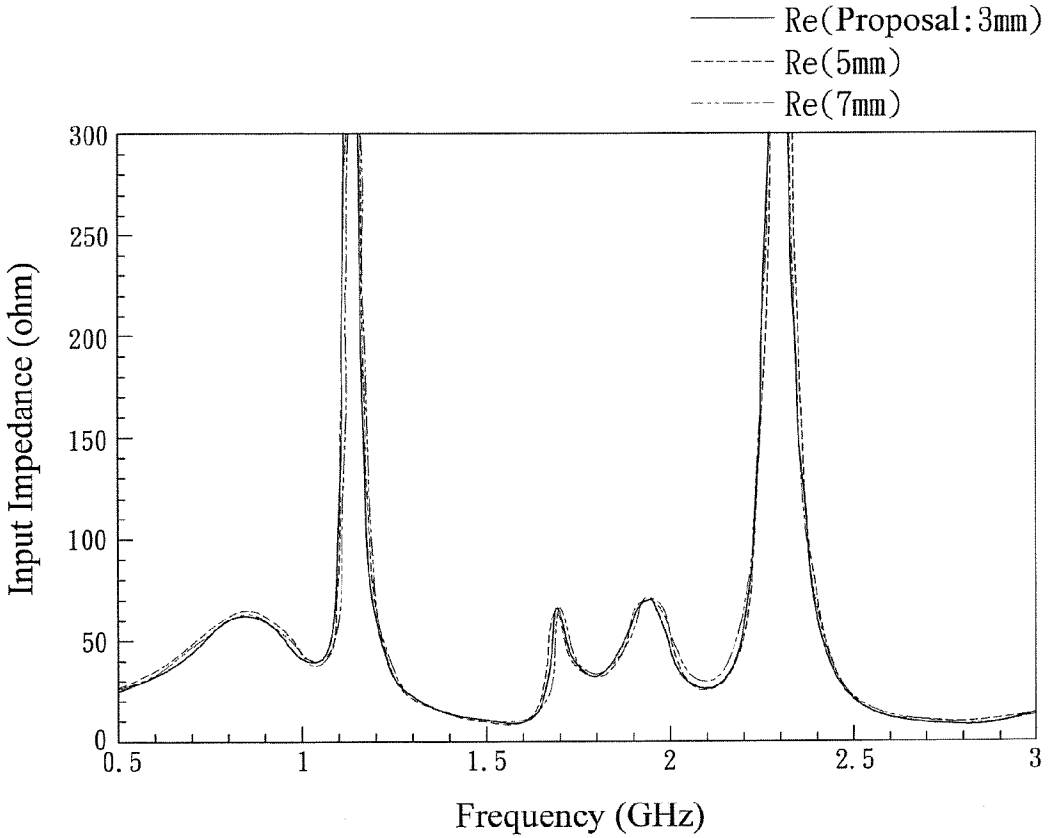
FIG. 9*b* is a schematic drawing showing effect of a slot on input impedance of an antenna according to the present invention.
Figure 9C:
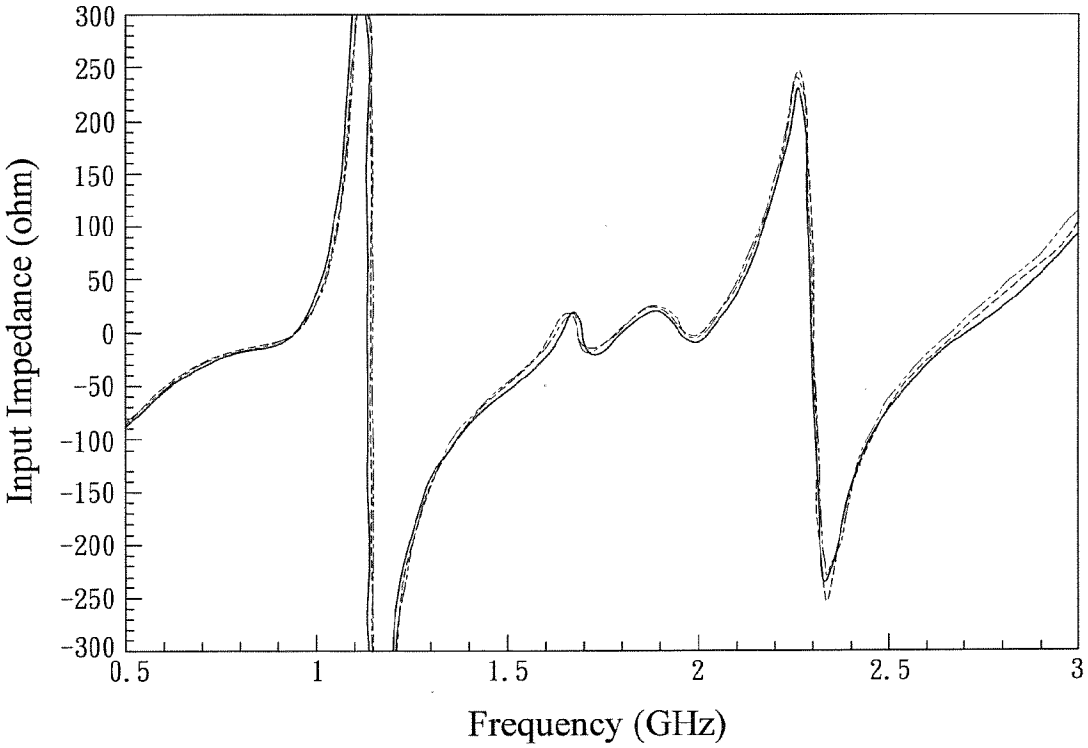
FIG. 9*c* is another schematic drawing showing effect of a slot on input impedance of an antenna according to the present invention.

Besides the slit 216 used for IF (intermediate frequency) matching, the slot 217 also has similar function. Refer to FIG. 9*a*, FIG. 9*b*, and FIG. 9*c*, the effect of the slot 217 on the return loss and the input impedance is revealed. When the position of the slot 217 is moved toward the inside of the metal plate 21, it is observed in the return loss of the FIG. 9*a* and the input impedance of the FIG. 9*b*, and FIG. 9*c* that the change of the slot 217 also has influence on the intermediate frequency matching, especially used for fine adjustment of the intermediate frequency matching.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A dual wideband dipole antenna comprising:

a dielectric substrate, two radiating metal portions that are disposed on the dielectric substrate and are corresponding to each other; and a feed line that connects a feeding point on each of the radiating metal portions;

wherein the radiating metal portion includes a metal plate, an L-shaped metal piece and a rectangular metal sheet; an initial end of the metal plate is disposed with the feeding point and a middle part of the metal plate is bent and extended toward the initial end to form a regulatory segment while a terminal end of the metal plate is bent and turned toward a first direction to form a projecting segment; the L-shaped metal piece is arranged between the terminal end of the metal plate and the regulatory segment; a terminal end of the L-shaped metal piece is bent and turned toward a second direction to form a turning portion; the rectangular metal sheet is arranged between the terminal end of the metal plate and a rear end of the regulatory segment of the other metal plate.

2. The device as claimed in claim 1, wherein a slit is formed on one side of the feeding point of the metal plate for intermediate frequency matching.

3. The device as claimed in claim 2, wherein a slot is mounted on the other side of the feeding point of the metal plate for intermediate frequency matching.

4. The device as claimed in claim 3, wherein the dielectric substrate is a substrate with a relative dielectric constant of 4.4 ($\in r$=4.4) and a loss tangent of 0.0245.

5. The device as claimed in claim 4, wherein the dielectric substrate is a FR4 substrate with a thickness of 0.8 mm and an area of 20×200 $mm^2$.

6. The device as claimed in claim 2, wherein the dielectric substrate is a substrate with a relative dielectric constant of 4.4 ($\in r$=4.4) and a loss tangent of 0.0245.

7. The device as claimed in claim 6, wherein the dielectric substrate is a FR4 substrate with a thickness of 0.8 mm and an area of 20×200 $mm^2$.

8. The device as claimed in claim 1, wherein a slot is mounted on the other side of the feeding point of the metal plate for intermediate frequency matching.

9. The device as claimed in claim 8, wherein the dielectric substrate is a substrate with a relative dielectric constant of 4.4 ($\in r$=4.4) and a loss tangent of 0.0245.

10. The device as claimed in claim 9, wherein the dielectric substrate is a FR4 substrate with a thickness of 0.8 mm and an area of 20×200 $mm^2$.

11. The device as claimed in claim 1, wherein the dielectric substrate is a substrate with a relative dielectric constant of 4.4 ($\in r$=4.4) and a loss tangent of 0.0245.

12. The device as claimed in claim 11, wherein the dielectric substrate is a FR4 substrate with a thickness of 0.8 mm and an area of 20×200 $mm^2$.

* * * * *